US005177467A

United States Patent [19]

Chung-Piao

[11] Patent Number: 5,177,467

[45] Date of Patent: Jan. 5, 1993

[54] ALARMING AND ENTERTAINING GLOVE

[76] Inventor: Tsao Chung-Piao, c/o Hung Hsing Patent Service Center, P.O. Box 55-1670, Taipei (10477), Taiwan

[21] Appl. No.: 804,037

[22] Filed: Dec. 9, 1991

[51] Int. Cl.[5] ..... G08B 7/00; G08B 13/00

[52] U.S. Cl. ..... 340/574; 200/DIG. 2; 340/432; 340/573; 340/693

[58] Field of Search ..... 340/573, 574, 693, 432; 200/DIG. 2

[56] References Cited

U.S. PATENT DOCUMENTS 1,046,225 12/1912 Schindler ..... 200/DIG. 2
1,165,970 12/1915 Harris ..... 200/DIG. 2
1,402,609 1/1922 Hodous ..... 200/DIG. 2
4,857,897 8/1989 Chen ..... 340/692

*Primary Examiner*—Glen R. Swann, III

[57] ABSTRACT

An alarming and entertaining glove includes a plurality of illuminators and buzzers mounted on a glove body electrically connected to an audio and optical driving circuit secured on the glove body, and at least one trigger switch formed on an inside surface portion of the glove preferably formed on an inside surface portion of any finger sheath and electrically connected to the audio and optical driving circuit, whereby upon a grasping of a wearer's hand or closing of the wearer's fingers with the hand, the trigger switch will be actuated to spread a warning sounding and to illuminate the illuminator for both audio and optical alarming purpose or for music sounding for entertaining purpose.

3 Claims, 6 Drawing Sheets

ALARMING AND ENTERTAINING GLOVE

BACKGROUND OF THE INVENTION

A conventional electronic alarm E may be mounted on a handle bar H of a bicycle B as shown in FIGS. 1, 2 having a pair of conductive metal blades S of a trigger switch formed on a back portion of the electronic alarm E, whereby upon a touch on the pair of metal blade S to conduct an electronic circuit for sounding a warning alarm and for illuminating plural lamps mounted on the alarm for safety or security purpose.

However, such a conventional electronic alarm has the following drawbacks:

1. In case of emergency situation, a bike driver may be panic to forget the depression of the alarm to lose its warning effect.

2. Such an alarm is detachably mounted on the handle bar H so that anybody or a thief may dismantle and steal it.

3. Whenever actuating the alarm, one of the driver's hands should leave his (her) grasped handlebar to touch the switch to remain a single hand for driving the bike to easily cause an unstable driving or even cause a traffic accident.

4. The alarm E is fixedly secured on the bike and can not be conveniently carried for a portable alarm use so as to limit its usages.

The present inventor has found the drawbacks of a conventional alarm and invented the present alarming glove.

SUMMARY OF THE INVENTION

The object of the present invention is to provide an alarming and entertaining glove including a plurality of illuminators and buzzers mounted on a glove body electrically connected to an audio and optical driving circuit secured on the glove body, and at least a trigger switch formed on an inside surface portion of the glove preferably formed on an inside surface portion of any finger sheath and electrically connected to the audio and optical driving circuit, whereby upon a grasping of a wearer's hand or closing of the wearer's fingers with the hand, the trigger switch will be actuated to spread a warning sounding and to illuminate the illuminators for both audio and optical alarming purpose or for music sounding for entertaining purpose.

DETAILED DESCRIPTION

Figure 1:
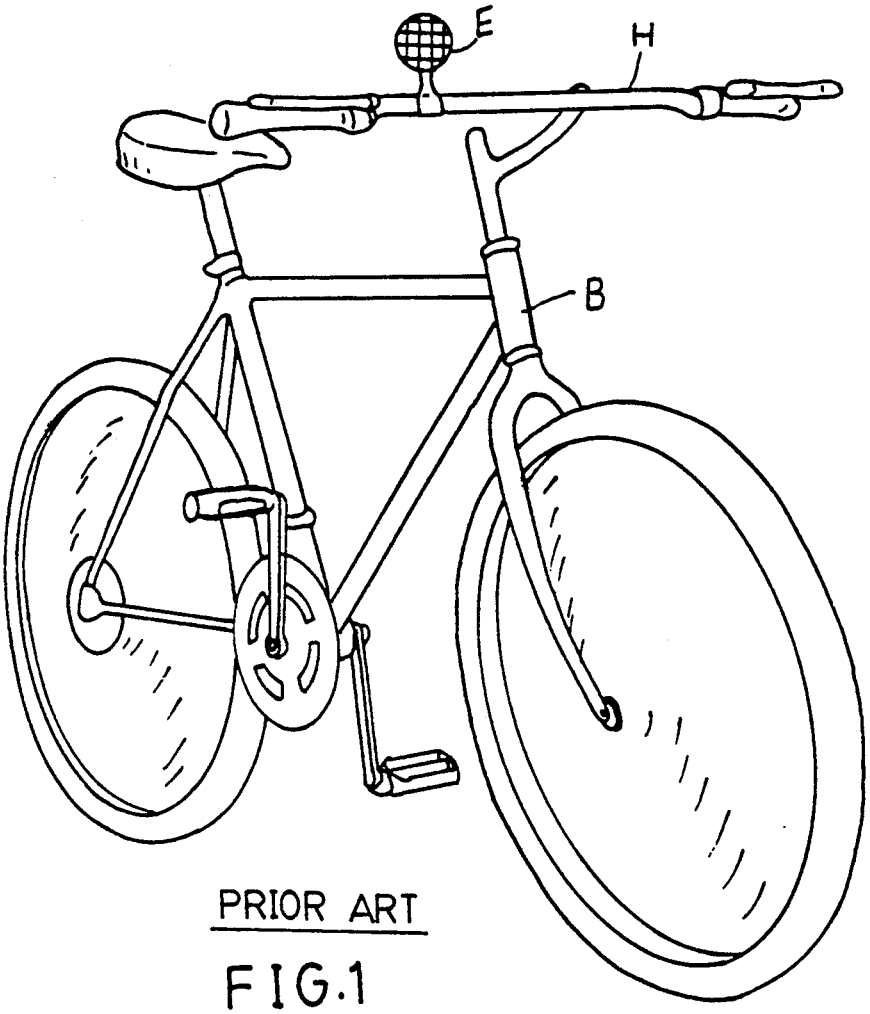
PRIOR ART FIG.1
FIG. 1 is an illustration showing a conventional electronic alarm mounted on a bicycle.
Figure 2:
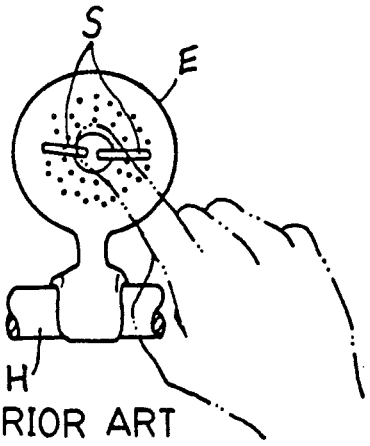
PRIOR ART FIG.2
FIG. 2 shows an operation of the conventional electronic alarm.
Figure 3:
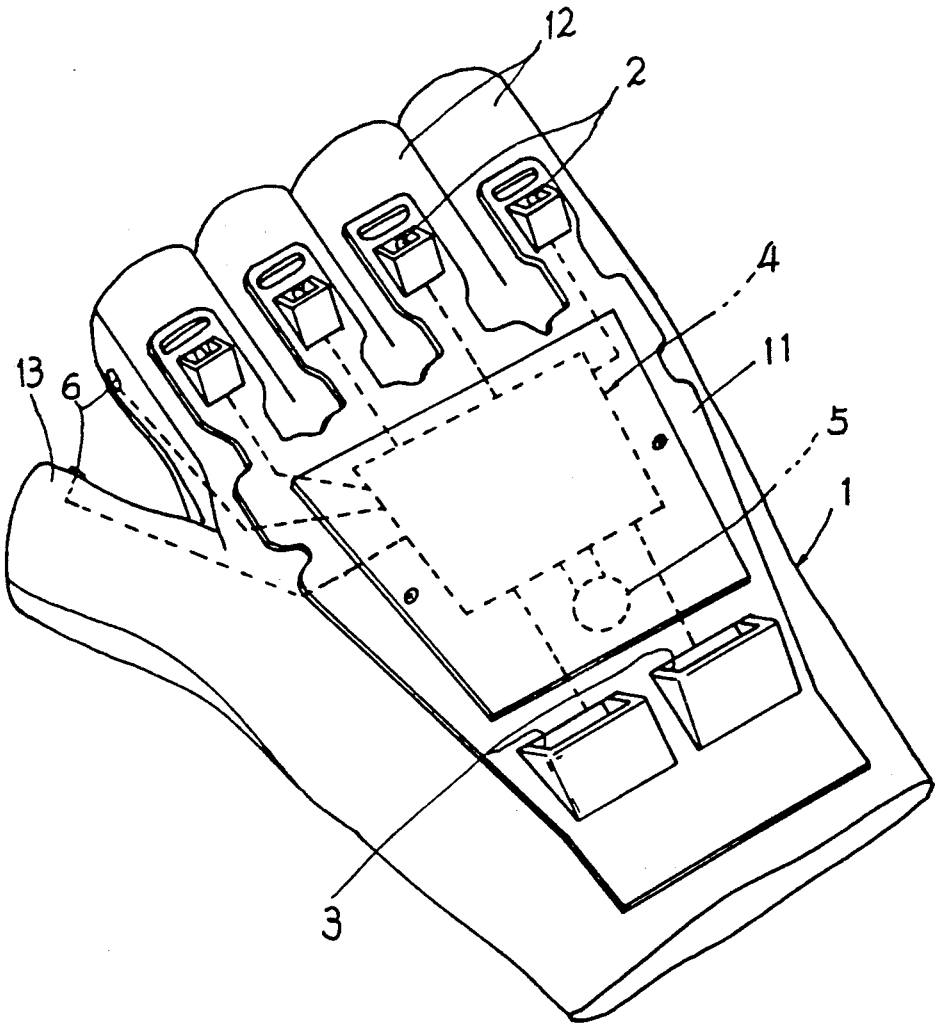
FIG. 3 is an illustration of the present invention.

As shown in FIG. 3, the present invention comprises: a glove body 1, a plurality of illuminators 2, a plurality of buzzers 3, an audio and optical driving means 4, a power source 5, and at least a trigger switch 6.

The glove body 1 includes: an insulating substrate sheet 11 formed on a back portion of the glove body 1 for mounting the audio and optical driving means 4, the illuminators 2, and the buzzers 3 on the substrate sheet 11, and a plurality of finger sheathes 12 including a thumb sheath 13 juxtapositionally formed on the glove body 1.

Each illuminator 2 is electrically connected to and driven by the audio and optical driving means 4 and is selected from: a light emitting diode, a bulb and any other lamps. The illuminators 2 are preferably secured on a back portion of each finger sheath 12 of the glove body 1, but not limited for positioning the illuminator on the glove body.

Each buzzer 3 is electrically connected to and driven by the audio and optical driving means 4.

The number, structure, kinds, positioning and shapes of the illuminators 2 and the buzzers 3 of the present invention are not limited in this invention.

The audio and optical driving means 4 is connected to the power source 5 to be powered by the power source 5. The driving means 4 may be an integrated circuit pre-programmed with a warning music or sound or a plurality of warning soundings for alarm warning purpose if served as an alarm or for entertaining purpose having plural musical soundings for amusing the user or wearer of the present invention, which can be continuously or intermittently sounded or randomly sounded as controlled by the integrated circuit which is conventional and not described in detail herewith; and the driving means 4 is also formed with a flashing driver in the integrated circuit for flashing the plurality of illuminators 12.

The power source 5 may be one or a plurality of batteries 5 connected with the driving means 4 for powering the same.

Figure 4:
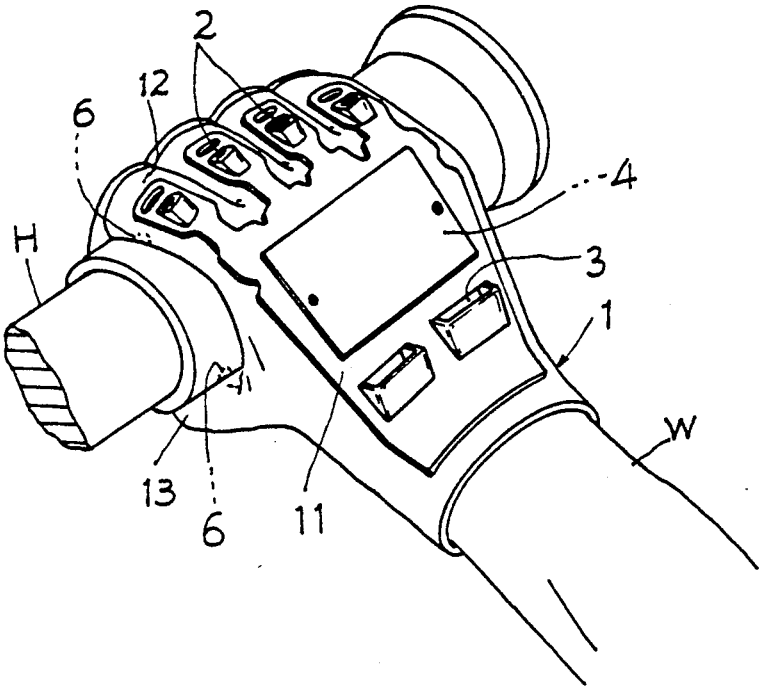
FIG. 4 shows a grasping of the present invention on a handle.
Figure 5:
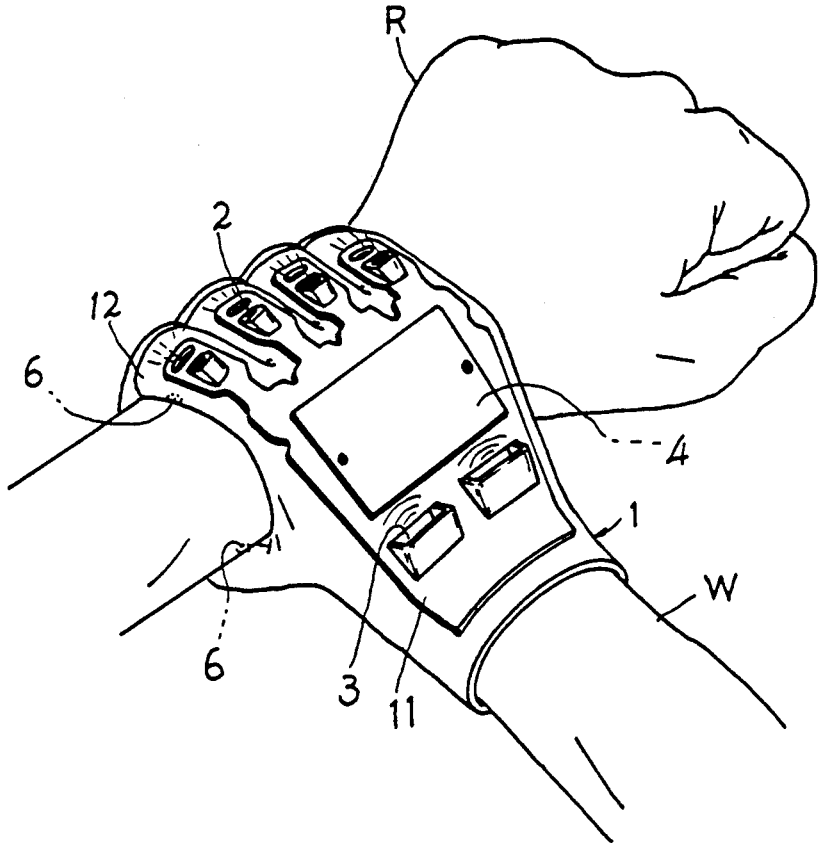
FIG. 5 shows a grasping of the present invention on an intruder's arm.
Figure 6:
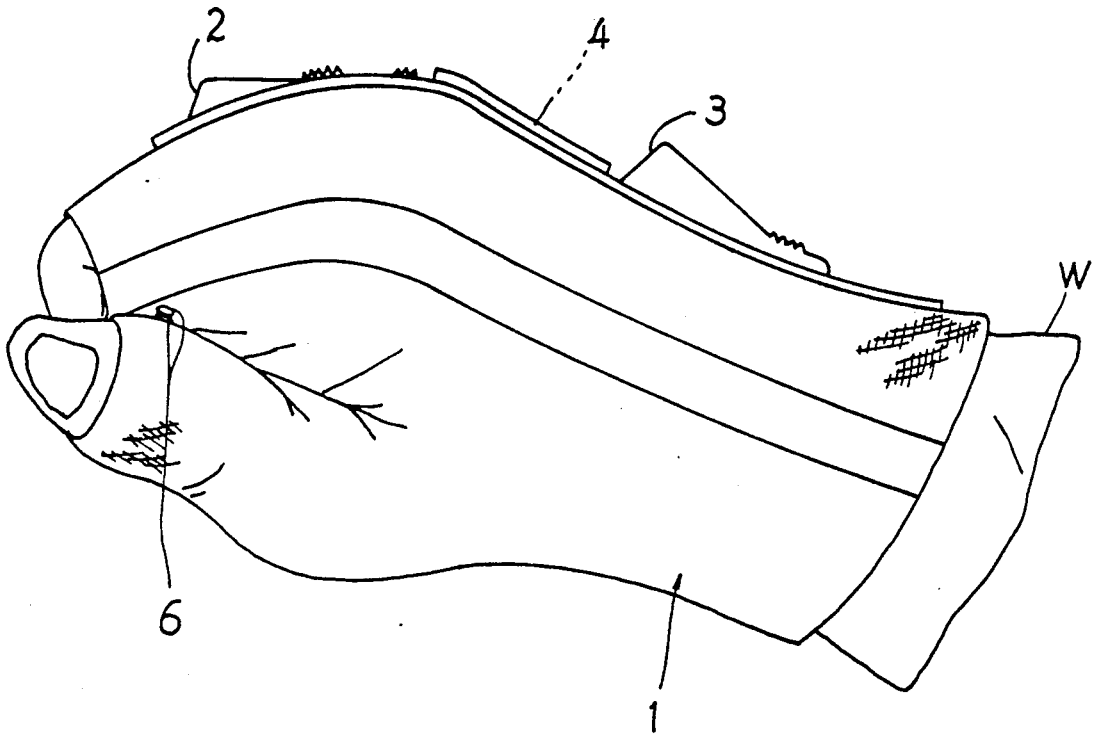
FIG. 6 shows a fist formed by grasping the present invention.

The trigger switch 6 may be secured on an inside surface of each finger sheath 12 or thumb sheath 13, which is operatively depressed when grasping the finger sheathes 12, 13 and the glove body 1 on a handle, a handle bar H as shown in FIG. 4 or on an intruder arm or hand H as shown in FIG. 5 such as a robber's arm, or even grasping the finger sheathes 12, 13 and the glove body 1 to form a fist as shown in FIG. 6 due to a natural human nervous reaction or response under panic condition or emergency situation, thereby actuating the driving means 4 for sounding the alarm warning through the buzzers 3 and for illuminating the illuminators 2 for audio and optical warning purposes, and or for entertaining uses.

The trigger switch 6 may be a pressure-sensitive switch which may be actuated to start and operate the driving means 4 under pressures such as when grasping the glove body or finger sheathes as aforementioned.

The trigger switch 6 may also be a micro-switch with spring loaded having a push button normally protruding outwardly from the switch for switching off the driving means 4 and operatively depressed for closing the integrated circuit of said driving means 4.

Other modifications of the switches 6 and other elements of the present invention may be modified by those skilled in the art without departing from the spirit and scope of the present invention.

The present invention is superior to a conventional electronic alarm with the following advantages:

1. Just by grasping the glove of a wearer's hand W on an article or human's arm, the alarm will be automatically sounded for an immediate warning use in case of emergency.

2. Due to a natural human nervous reaction in response to a panic or emergency situation, the wearer's hand wearing the glove of this invention may be naturally closed or grasped for actuating the switches 6 for starting the driving means 4 for the alarm sounding both optically and musically.

3. For entertaining purposes, it is quite curious, fancy, favorite and fantastic capable of spurring a wearer's interest for amusement.

4. A lady may wear such a glove so that she may actuate the alarm in case of an emergency situation such as being possibly raped or before raped just by grasping her hand and the glove worn in situ.

5. A robber or intruder may lose his attention or may not care about this device by inherently incorporating an alarm on a glove so that the glove wearer may have enough time to actuate the alarm for asking help when being robbed. Also, the glove built in with an alarm will not be easily removed by the robber or intruder to prevent an interruption of an alarm spreading, thereby ensuring an alarm warning operation for better safety and security meaning.

Figure 3A:
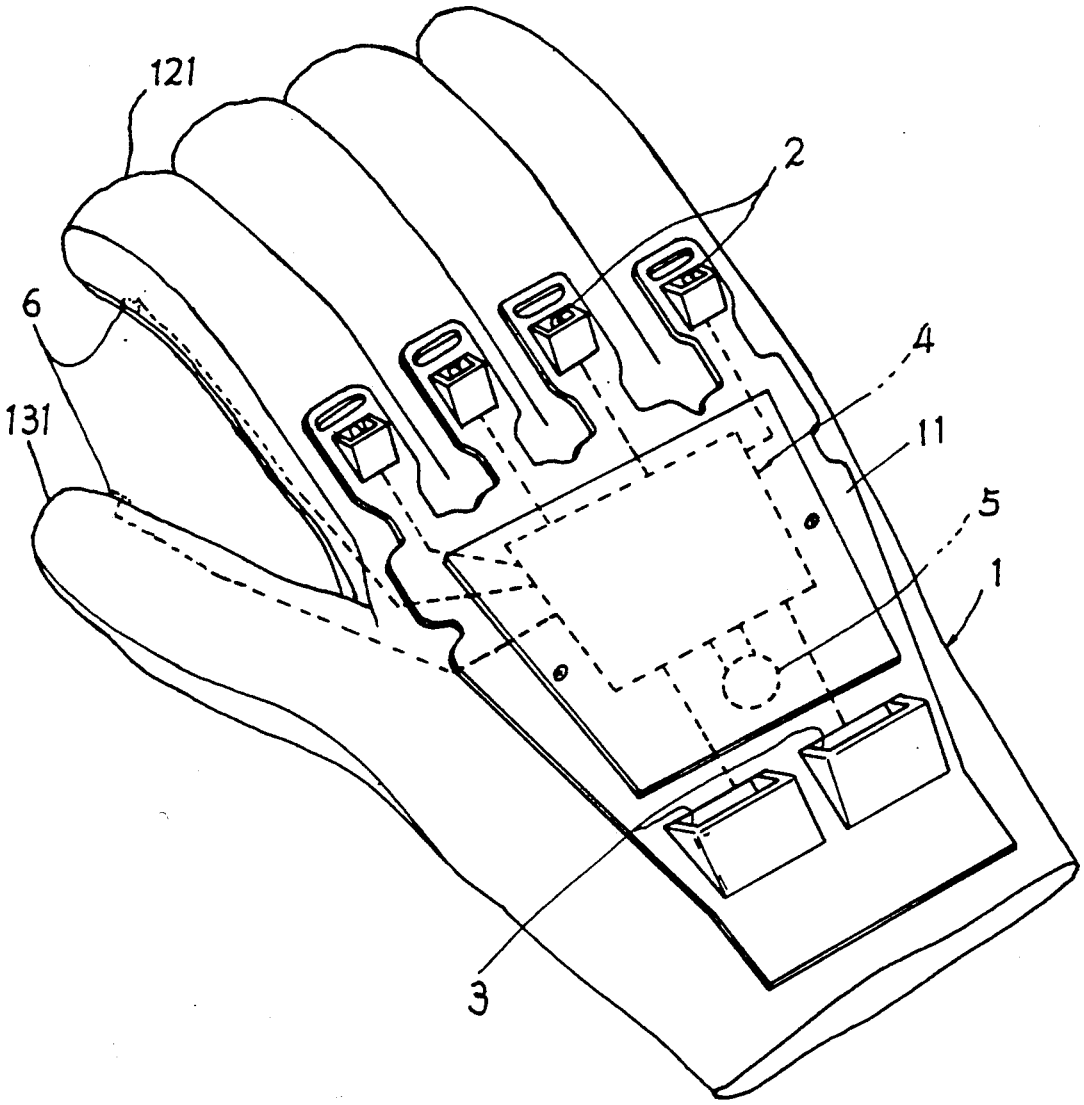
FIG. 3*a* shows another modification of the invention from FIG. 3.

The finger sheathes 12, 13 may be extended to be full sheathes 121, 131 as shown in FIG. 3*a*.

Two switches 6 provided in this invention as shown in FIG. 4 may be modified to have a first switch secured on the thumb finger sheath 13 for operatively warning alarm for emergency call for help and to have a second switch secured on the index finger sheath 12 for operatively selecting a variety of musical soundings for amusement purposes.

I claim:

1. An alarming and entertaining glove comprising:

a glove body having a plurality of finger sheathes including a thumb sheath juxtapositionally formed on said glove body;

a plurality of illuminators and buzzers respectively formed on said glove body, each said illuminator secured on a back portion of said finger sheath of the glove body;

an audio and optical driving means mounted on said glove body electrically connected with said illuminators and said buzzers, and electrically connected with a power source to be powered by said power source secured on said glove body, said driving means operatively actuating an alarm or musical sounding through said buzzers and operatively illuminating said illuminators; and at least one trigger switch secured on an inside surface of each finger sheath of said glove body, which is operatively actuated when grasping the finger sheathes and the glove body on an article or grasping for forming a fist to start operation of said driving means for sounding said buzzers and illuminating said illuminators upon a grasping of said glove body and said finger sheathes.

2. A glove according to claim 1, wherein said trigger switch is a pressure-sensitive switch operatively actuated to start and operate said driving means when the glove body and finger sheathes are grasped.

3. A glove according to claim 1, wherein said trigger switch is a micro-switch having a spring-loaded push button normally protruding outwardly from the switch for switching off the driving means and being depressed for actuating said driving means.

* * * * *